US012540548B2

(12) United States Patent
Reeves

(10) Patent No.: US 12,540,548 B2
(45) Date of Patent: Feb. 3, 2026

(54) CUTTING DEVICE AND SUPPORT FOR SAME

(71) Applicant: Joy Global Underground Mining LLC, Warrendale, PA (US)

(72) Inventor: Stuart Reeves, North Wollongong (AU)

(73) Assignee: Joy Global Underground Mining LLC, Warrendale, PA (US)

( * ) Notice: Subject to any disclaimer, the term of this patent is extended or adjusted under 35 U.S.C. 154(b) by 104 days.

(21) Appl. No.: 18/417,985

(22) Filed: Jan. 19, 2024

(65) Prior Publication Data

US 2024/0247587 A1 Jul. 25, 2024

Related U.S. Application Data

(60) Provisional application No. 63/480,824, filed on Jan. 20, 2023.

(51) Int. Cl.
*E21C 25/18* (2006.01)
*E21D 9/10* (2006.01)

(52) U.S. Cl.
CPC ..... *E21C 25/18* (2013.01); *E21D 9/1026* (2013.01)

(58) Field of Classification Search
CPC ..... E21D 9/1026; E21C 25/18
See application file for complete search history.

(56) References Cited

U.S. PATENT DOCUMENTS

| | | | | |
|---|---|---|---|---|
| 747,869 | A * | 12/1903 | Drake | E21C 35/20 244/53 A |
| 3,333,895 | A * | 8/1967 | Anderson | E21C 31/10 91/40 |
| 4,290,494 | A * | 9/1981 | Blanz | E21D 20/003 173/160 |
| 4,377,311 | A | 3/1983 | Seller | |
| 2003/0136586 | A1 | 7/2003 | Schneider et al. | |
| 2013/0319655 | A1 | 12/2013 | Schultz et al. | |
| 2018/0051561 | A1 | 2/2018 | Daher et al. | |
| 2021/0140239 | A1 | 5/2021 | Miess et al. | |

OTHER PUBLICATIONS

International Search Report and Written Opinion for Application No. PCT/US2024/012249, dated Apr. 19, 2024, 13 pages.

* cited by examiner

*Primary Examiner* — Janine M Kreck
(74) *Attorney, Agent, or Firm* — Husch Blackwell LLP

(57) ABSTRACT

A cutting assembly is provided for a rock excavation machine having a frame. The cutting assembly includes a base portion configured to be supported by the frame, a flexible shaft, and a cutting device. The base portion defines a base axis. The flexible shaft includes a first end and a second end opposite the first end. The first end is coupled to the base portion, and the second end is movable relative to the first end and deflectable away from the base axis. The cutting device is supported on the second end of the flexible shaft.

20 Claims, 13 Drawing Sheets

CUTTING DEVICE AND SUPPORT FOR SAME

CROSS-REFERENCE TO RELATED APPLICATION

This application claims the benefit of prior-filed, U.S. Provisional Patent Application No. 63/480,824, filed Jan. 20, 2023, the entire contents of which are incorporated by reference.

TECHNICAL FIELD

The present disclosure relates to mining and excavation machines, and in particular to a cutting device for a mining or excavation machine.

BACKGROUND

Hard rock mining and excavation typically requires imparting large energy on a portion of a rock face in order to induce fracturing of the rock. One conventional technique includes operating a cutting head having multiple mining picks. Due to the hardness of the rock, the picks must be replaced frequently, resulting in extensive down time of the machine and mining operation. Another technique includes drilling multiple holes into a rock face, inserting explosive devices into the holes, and detonating the devices. The explosive forces fracture the rock, and the rock remains are then removed and the rock face is prepared for another drilling operation. This technique is time-consuming and exposes operators to significant risk of injury due to the use of explosives and the weakening of the surrounding rock structure. Yet another technique utilizes roller cutting element(s) that rolls or rotates about an axis that is parallel to the rock face, imparting large forces onto the rock to cause fracturing.

SUMMARY

In one independent aspect, a cutting assembly is provided for a rock excavation machine having a frame. The cutting assembly includes a base portion configured to be supported by the frame, the base portion defining a base axis; a flexible shaft including a first end and a second end opposite the first end, the first end coupled to the base portion, the second end being movable relative to the first end and deflectable away from the base axis; and a cutting device supported on the second end of the flexible shaft.

In some aspects, the base portion includes a first structure and a second structure that is supported for movement relative to the first structure along the base axis, the second structure including a first end and a second end opposite the first end.

In some aspects, the flexible shaft is movable with the second structure along the base axis, and the second end of the flexible shaft is movable relative to the second structure about a pivot point, the pivot point positioned between the first end and the second end of the flexible shaft.

In some aspects, the base portion includes an elongated slot, and further comprising a linkage coupled to the second structure and including an end positioned within the slot and movable within the slot, engagement between the linkage and the slot resisting torque exerted on the second structure.

In some aspects, the cutting assembly further includes a gear drive for rotating the flexible shaft relative to the second structure about the base axis, the gear drive supported on a bracket positioned adjacent a first end of the second structure.

In some aspects, the cutting device includes a cutting disc having a cutting edge positioned in a cutting plane, and the cutting plane is oriented at a non-perpendicular angle relative to an axis of the flexible shaft proximate the second end of the flexible shaft.

In some aspects, the cutting device includes a cutting disc and an excitation device, the excitation device including an eccentric mass supported for rotation in an eccentric manner and positioned proximate the cutting disc, rotation of the eccentric mass inducing oscillation of the cutting device, and oscillation of the cutting device inducing oscillation of the flexible shaft.

In some aspects, the flexible shaft is constructed from one or more of steel, aluminum, and/or a titanium alloy.

In some aspects, the first end of the flexible shaft has a first width, the second end of the flexible shaft has a second width, and the flexible shaft has a third width at a location between the first end and the second end, the third width being smaller than the first width and the second width.

In some aspects, a ratio of the first width to the third width is approximately 2 to 1.

In another independent aspect, a cutting assembly for a rock excavation machine includes: a base portion; a cutting device including a cutting edge; and a flexible shaft supporting the cutting device relative to the base portion. The flexible shaft includes a first end, a second end opposite the first end, and a shaft axis extending therebetween. The first end is coupled to the base portion, and the second end is coupled to the cutting device. A width of the flexible shaft tapers inwardly in a direction between the first end and an intermediate position located between the first end and the second end, and the width of the flexible shaft tapers inwardly in a direction between the second end and the intermediate position. The width of the flexible shaft proximate the intermediate position is less than the width proximate the first end and less than the width proximate the second end.

In some aspects, the base portion includes a first structure and a second structure that is supported for movement relative to the first structure along a base axis, the second structure including a first end and a second end opposite the first end, the flexible shaft coupled to the second structure, the cutting device positioned adjacent the first end of the second structure.

In some aspects, the flexible shaft is movable with the second structure along the base axis, and the second end of the flexible shaft is movable relative to the second structure about a pivot point, the pivot point positioned between the first end and the second end of the flexible shaft.

In some aspects, the base portion includes an elongated slot, and the cutting assembly further incudes a linkage coupled to the second structure and including an end positioned within the slot and movable within the slot, engagement between the linkage and the slot resisting torque exerted on the second structure.

In some aspects, the cutting assembly further includes a gear drive for rotating the flexible shaft relative to the second structure about the base axis, the gear drive supported on a bracket positioned adjacent a first end of the second structure.

In some aspects, the cutting device includes a cutting disc having a cutting edge positioned in a cutting plane, and the cutting plane is oriented at a non-perpendicular angle relative to an axis of the flexible shaft proximate the second end of the flexible shaft, the cutting device further including a cutting disc and an excitation device, the excitation device including an eccentric mass supported for rotation in an eccentric manner and positioned proximate the cutting disc, rotation of the eccentric mass inducing oscillation of the cutting device, and oscillation of the cutting device inducing oscillation of the flexible shaft.

In some aspects, a ratio of the first width to the third width is approximately 2 to 1.

In yet another independent aspect, a cutting assembly for a rock excavation machine includes: a base portion including a first structure and a second structure supported for movement relative to the first structure along a base axis; a cutting device including a cutting edge, the cutting device positioned adjacent a distal end of the second structure; and a flexible shaft including a first end, a second end opposite the first end, and a shaft axis extending therebetween. The flexible shaft further includes an intermediate position located between the first end and the second end. Deflection of the flexible shaft moves the second end away from the base axis. The first end is coupled to a proximal end of the second structure, and the second end is coupled to the cutting device. A width of the flexible shaft reduces inwardly in a direction between the first end and the intermediate position, and the width of the flexible shaft reduces inwardly in a direction between the second end and the intermediate position. The width of the flexible shaft proximate the intermediate position is less than the width proximate the first end and less than the width proximate the second end.

In some aspects, the base portion includes an elongated slot, and the cutting assembly further includes a linkage coupled to the second structure, the linkage including an end positioned within the slot and movable within the slot, engagement between the linkage and the slot maintaining the second structure in a desired orientation relative to the first structure.

In some aspects, the cutting assembly includes a gear drive for rotating the flexible shaft relative to the second structure about the base axis, the gear drive supported on a bracket positioned adjacent a first end of the second structure.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects may be implemented in software (for example, stored on non-transitory computer-readable medium) executable by one or more processing units, such as a microprocessor, an application specific integrated circuits ("ASICs"), or another electronic device. As such, it should be noted that a plurality of hardware and software based devices, as well as a plurality of different structural components may be utilized to implement the disclosure. For example, "controllers" described in the specification may include one or more electronic processors or processing units, one or more computer-readable medium modules, one or more input/output interfaces, and various connections (for example, a system bus) connecting the components.

Figure 1:
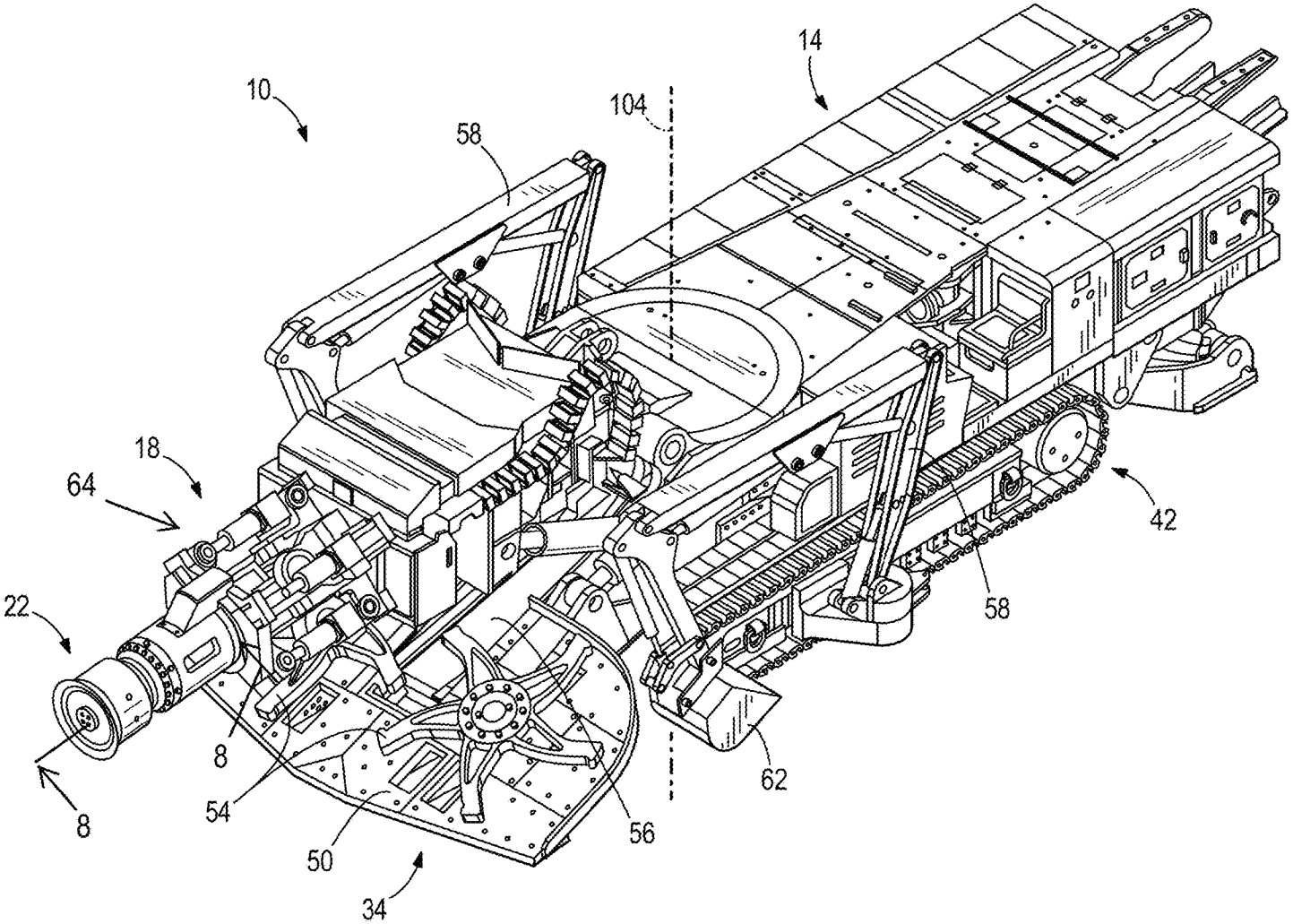
FIG. 1 is a perspective view of an excavation machine including a boom of the prior art.
Figure 2:
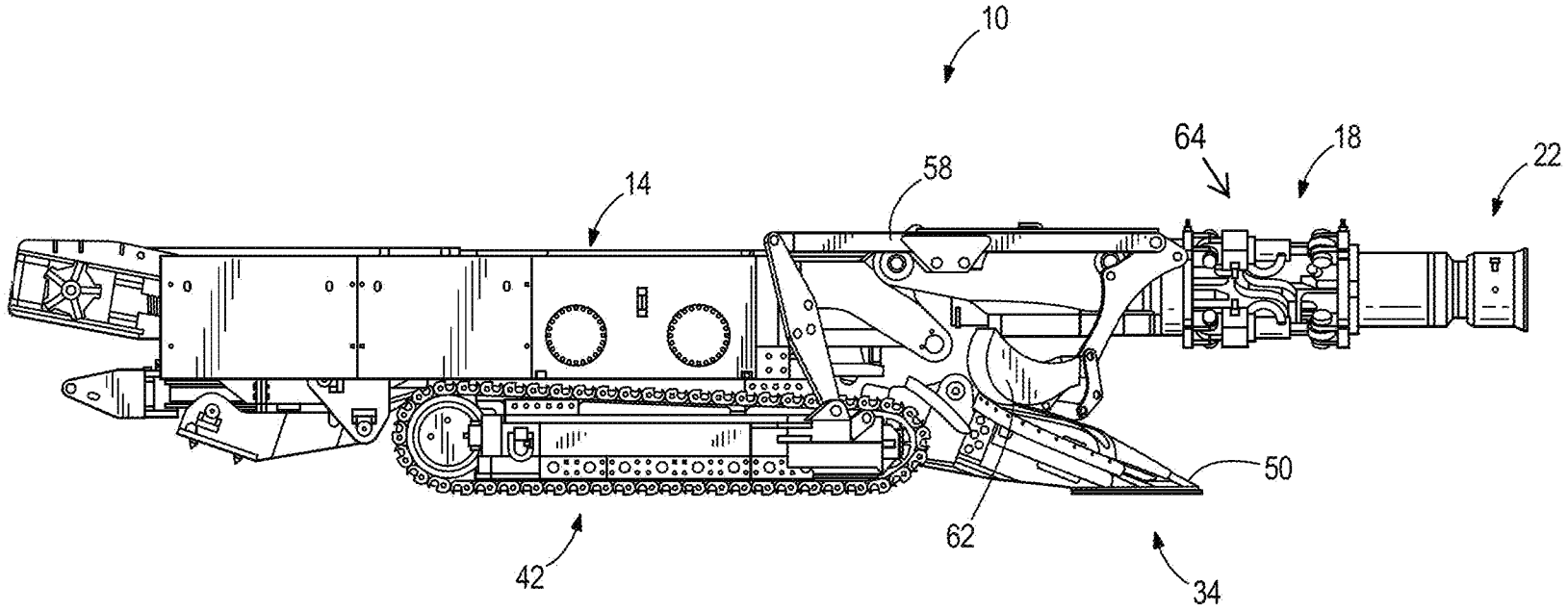
FIG. 2 is side view of the excavation machine of FIG. 1.

FIGS. 1 and 2 illustrate an exemplary excavation machine or mining machine 10 including a chassis 14, a boom 18, a cutting head or cutting device 22 for engaging a rock face 30 (FIG. 4), and a material gathering head or gathering device 34. In the illustrated embodiment, the chassis 14 is supported on a crawler mechanism 42 for movement relative to a floor (not shown). The gathering device 34 includes a deck 50 and rotating arms 54. As the machine 10 advances, the cut material is urged onto the deck 50, and the rotating arms 54 move the cut material onto a conveyor 56 (FIG. 1) for transporting the material to a rear end of the machine 10. In other embodiments, the arms 54 may slide or wipe across a portion of the deck 50 (rather than rotating) to direct cut material onto the conveyor 56. Furthermore, in some embodiments, the gathering device 34 may also include a pair of articulated arms 58, each of which supports a bucket 62. The articulated arms 58 and buckets 62 may remove material from an area in front of the machine 10 and may direct the material onto the deck 50. In the embodiment illustrated in FIG. 1, the boom 18 may extend and retract in a telescoping manner, and the boom 18 may include a universal joint 64, permitting the cutting device 22 to pivot about axes of the universal joint 64.

Figure 3:
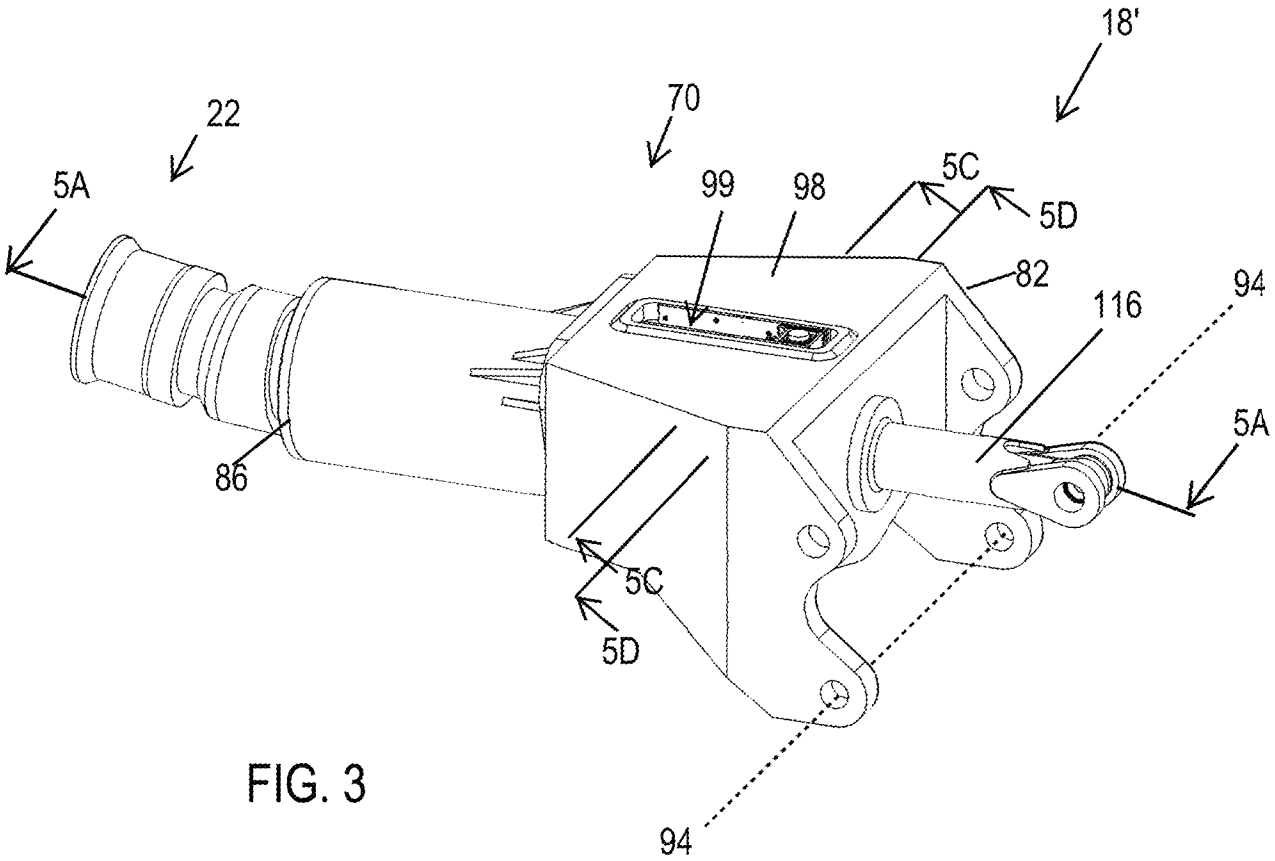
FIG. 3 is a perspective view of a boom according to one embodiment and a cutting device coupled to the boom.
Figure 4:
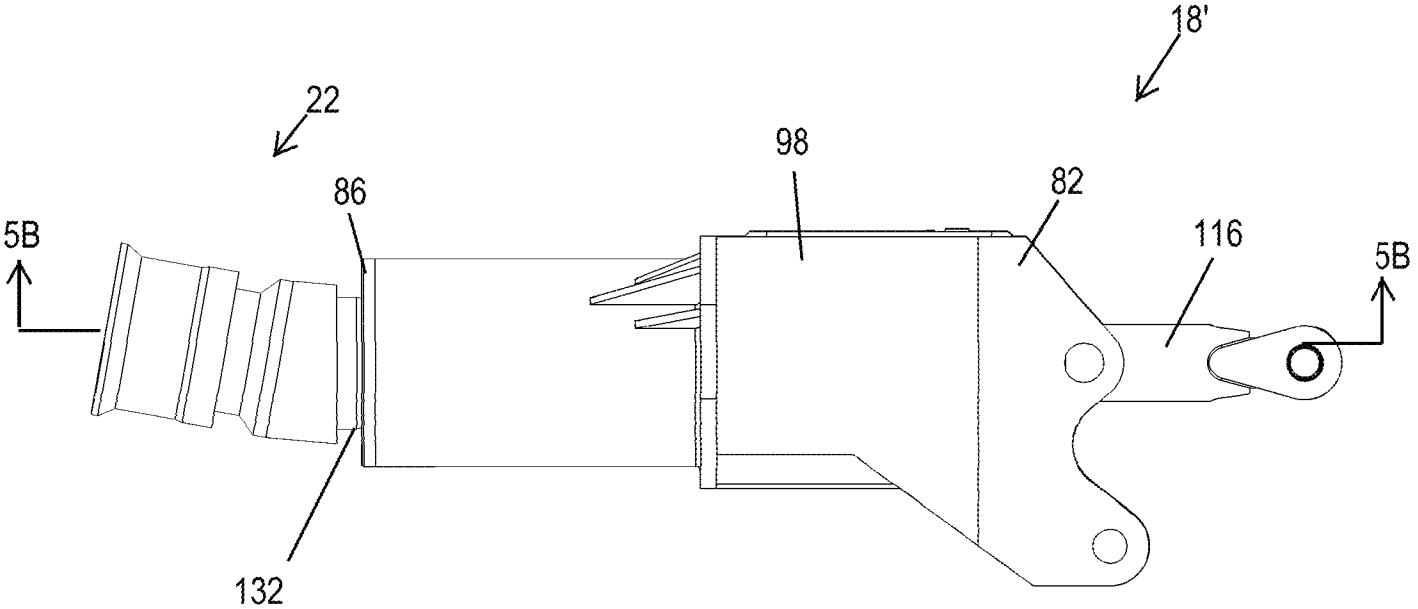
FIG. 4 is a side view of the boom and the cutting device of FIG. 3.

FIGS. 3 and 4 illustrate a boom 18' according to another embodiment. The boom 18' supports the cutting device 22. The boom 18' includes a first portion or base portion 70 (FIG. 3) and a second portion or wrist portion 74 (FIGS. 5A, 5B, and 6B) that supports the cutting device 22. The base portion 70 includes a first end 82 and a second end 86. The first end may be coupled to and supported on a chassis (e.g., the chassis 14 shown in FIG. 2). A base axis 90 (FIG. 5A) extends along the base portion 70 between the first end 82 and the second end 86. In one embodiment, the first end 82 is pivotable relative to the chassis 14 about a transverse axis 94 (FIG. 3) oriented perpendicular to the base axis 90. In some embodiments, the transverse axis 94 may be offset from the base axis 90 such that the transverse axis 94 and base axis 90 do not intersect.

In the illustrated embodiment, the boom 18' is formed as a first structure 98 that extends from the first end 82 to the second end 86 and a second structure 100 (FIGS. 5A-6A) that is at least partially positioned within and movable relative to the first structure 98. The first structure 98 is pivotable and includes an opening 102 that receives the second structure 100 in an extendable or telescoping manner. The first structure 98 is pivotable about the transverse axis 94 and may also be pivoted laterally about a vertical axis or slew axis 104 (FIG. 1) (e.g., by rotation of a turntable coupling). In the illustrated embodiment, the first structure 98 includes an elongated slot or opening 99 oriented parallel to the base axis 90.

Figure 5A:
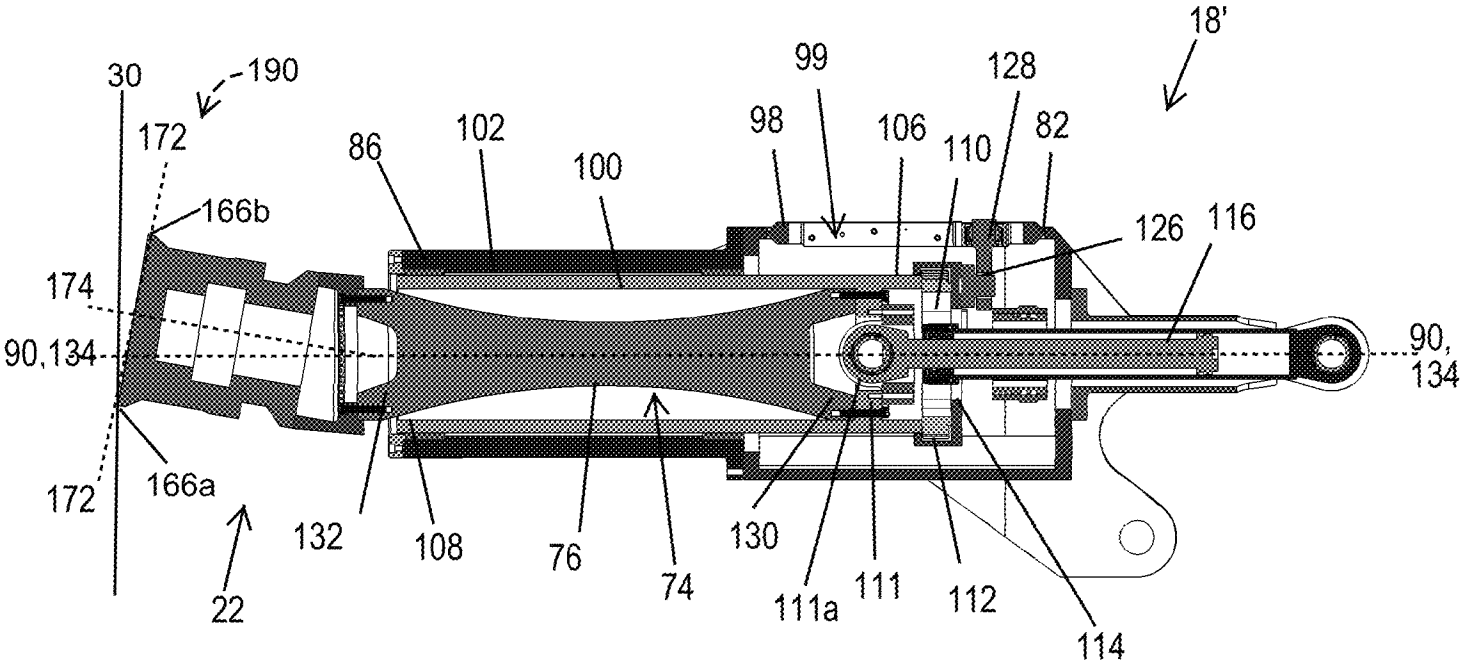
FIG. 5A is a cross-sectional view of the boom and cutting device of FIG. 3 along the line 5A-5A of FIG. 3 and illustrating a flexible shaft.
Figure 5B:
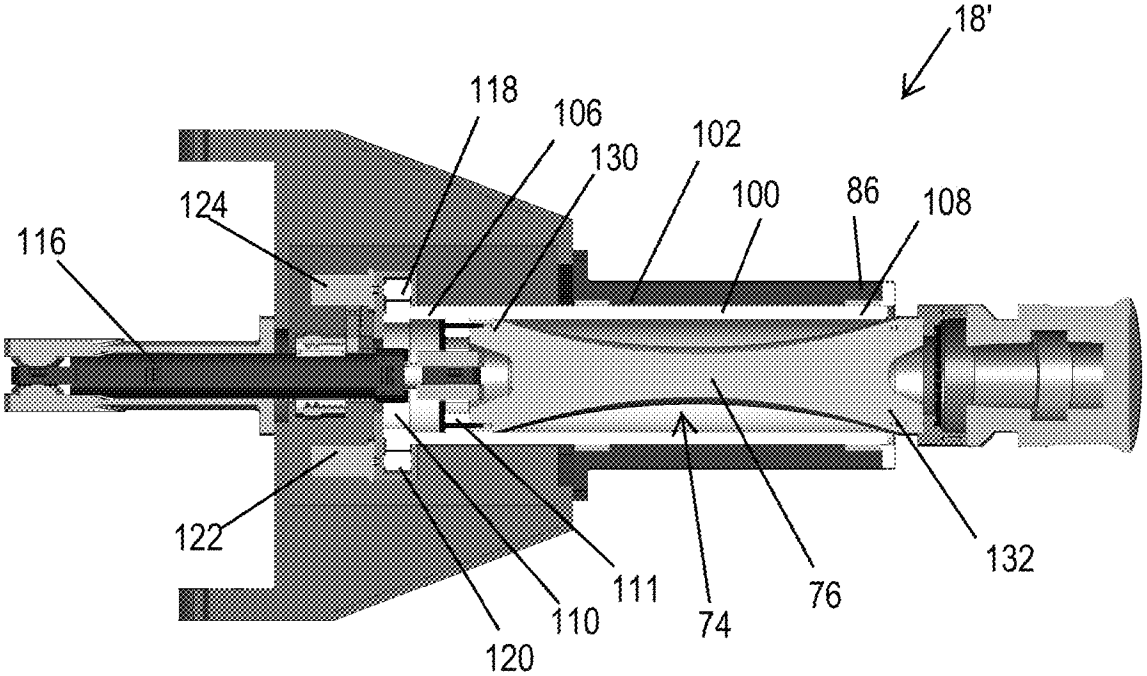
FIG. 5B is a cross-sectional view of the boom and cutting device of FIG. 3 along the line 5B-5B of FIG. 4 and illustrating the flexible shaft.

As shown in FIGS. 5A and 5B, the second structure 100 includes a hollow shaft and has a first end 106 positioned within the first structure 98 and a second end 108 opposite the first end 106. In the illustrated embodiment, a shaft driven gear 110 is positioned adjacent the first end 106 and is concentric with the first end 106. The hollow shaft also includes a coupler 111 extending from an inner wall. The coupler 111 has an aperture 111*a* (FIG. 5A). A bracket 112 is coupled to the first end 106 and the shaft driven gear 110 is positioned within bracket 112. The bracket 112 includes an aperture 114 (FIG. 5A) that is generally aligned with the aperture 111*a* in the coupler 111. A fluid actuator 116 (e.g., a hydraulic cylinder) extends through the apertures 111*a*, 114.

Figure 5C:
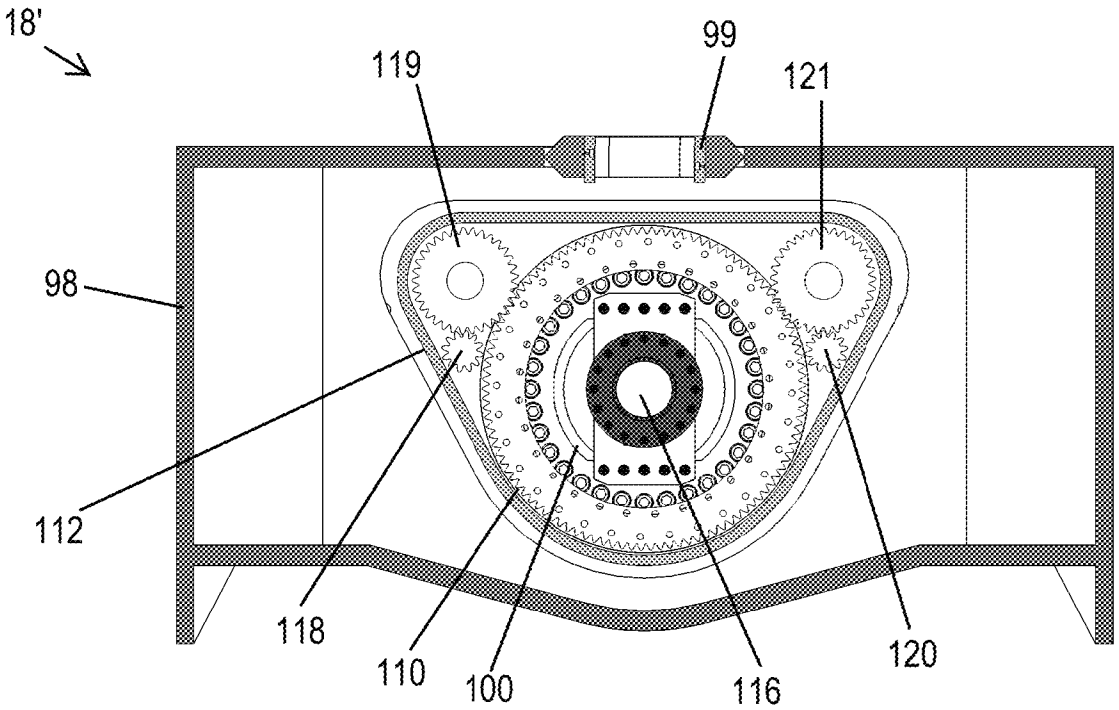
FIG. 5C is a cross-sectional view of the boom of FIG. 3 along the line 5C-5C of FIG. 3.
Figure 6A:
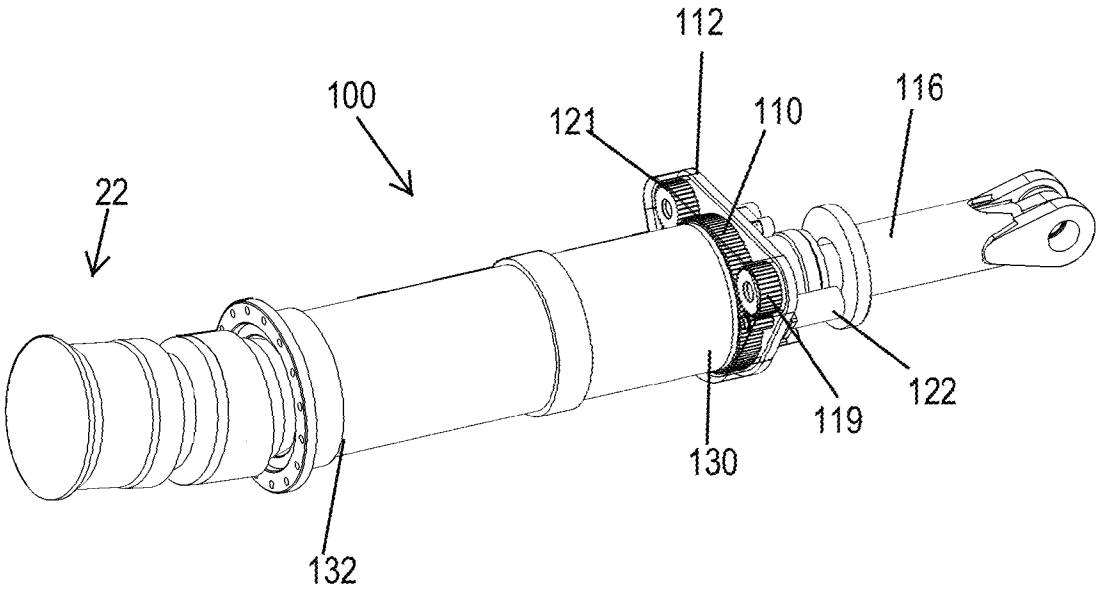
FIG. 6A is a perspective view of the boom of FIG. 3 with a portion removed.

As shown in FIGS. 5C and 6A, in the illustrated embodiment, the bracket 112 supports a drive mechanism, which in this case is a slew drive. For example, the bracket 112 may support a first drive gear 118, a first driven gear 119 operatively engaged with the first drive gear and the shaft driven gear 110, a second drive gear 120, and a second driven gear 121 operatively engaged with the second drive gear 120 and the shaft driven gear 110. The first drive gear 118 is actuated by a first motor 122 (FIG. 5B) and the second drive gear 120 is actuated by a second motor 124 (FIG. 5B). The first and second motors 122, 124 actuate (e.g., rotate) the respective first and second drive gears 118, 120, which in turn actuate (e.g., rotate) the respective first and second driven gears 119, 121. Actuation of the first and second driven gears 119, 121 thereby drive or rotate the shaft driven gear 110. Rotation of the shaft driven gear 110 correspondingly rotates the second structure 100.

Figure 5D:
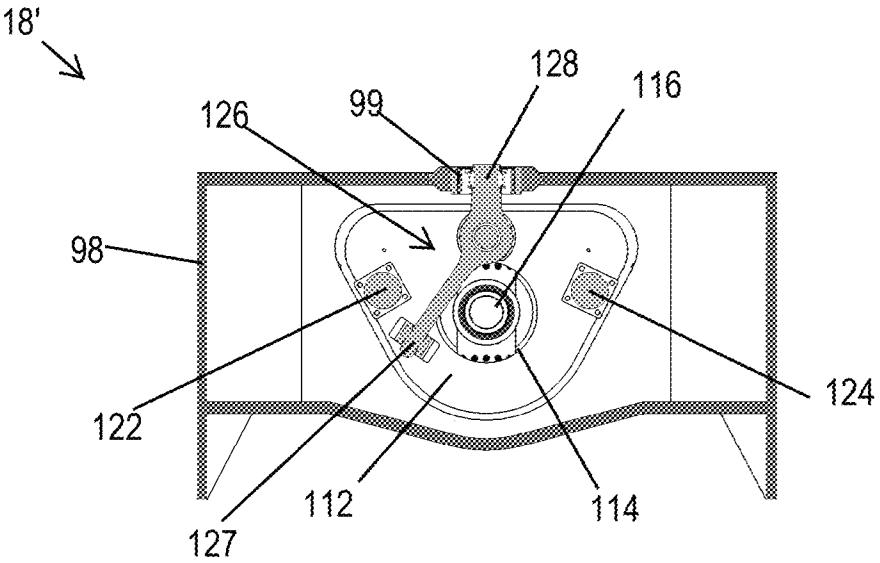
FIG. 5D is a cross-sectional view of the boom of FIG. 3 along the line 5D-5D of FIG. 3.

In the illustrated embodiment, the second structure 100 is also movable along the base axis 90 (e.g., the second structure 100 is extended and retracted due to operation of the fluid actuator 116). As shown in FIG. 5D, a linkage 126 includes a first end 127 that is supported by the bracket 112 and a second end 128 that is movably supported within the opening 99 of the base portion 70. The engagement between the linkage 126 and the opening 99 assists in maintaining the alignment of the second structure 100 with the first structure 98. Moreover, the configuration of the linkage 126 provides a torque reaction feature, resisting torque exerted on the bracket 112 (e.g., due to the impact of the cutting device 22 against a rock wall).

The wrist portion 74 includes a flexible shaft 76 and is at least partially positioned within and supported by the second structure 100. The flexible shaft 76 may move (e.g., extend and retract) with the second structure 100 of the base portion 70, such that the flexible shaft 76 selectively extends and retracts the second structure 100 in a direction parallel to the base axis 90. The flexible shaft 76 includes a first end 130 and a second end 132, and a wrist axis 134 (FIG. 5A) extends between the first end 130 and the second end 132. The first end 130 is coupled at or adjacent to the first end 106 (FIG. 5A) of the second structure 100, and may be coupled to the coupler 111 (e.g., via fasteners). The first end 130 is coupled to the fluid actuator 116. The second end 132 of the flexible shaft 76 is positioned at or adjacent to the second end 108 of the second structure 100. In the illustrated embodiment, the second end 132 of the flexible shaft 76 is positioned outwardly from the second end 108 of the second structure 100 and outwardly from the second end 86 of the base portion 70 (FIG. 5A). In other embodiments, the second end 132 may be positioned at the second end 108 of the second structure 100, or may be recessed relative to the second structure 100. The second end 132 of the flexible shaft 76 is supported by the second end 108 of the second structure 100, and the cutting device 22 is coupled to the second end 132 of the flexible shaft 76.

The flexible shaft 76 may be constrained via its coupling to the first end 106 of the second structure 100 and also by the opening 102 of the second structure 100. In some embodiments, while the flexible shaft 76 is in a rest position (e.g., a non-deflected position), the wrist axis 134 may be oriented substantially parallel to the base axis 90. The flexible shaft 76 is rotatable and translatable with the second structure 100 of the first portion 70 because it is coupled to the second structure 100. Moreover, the flexible shaft 76 is supported in a cantilevered manner. The first end 130 of the flexible shaft 76 is secured with respect to the second structure 100, and the second end 132 of the flexible shaft 76 is permitted to move (e.g., deflect) relative to the first end 130. The movement of the flexible shaft 76 relative to the second structure 100 and the base portion 70 will be discussed in greater detail below.

In the illustrated embodiment, the flexibility of the flexible shaft 76 is determined (at least partially) by the material composition of the shaft 76. The flexible shaft 76 may be formed from any suitable material, such as steel, aluminum, a titanium alloy, or a combination of these with one another and/or with one or more additional materials. Additionally, the material of the flexible shaft 76 may include one or more of these materials. In some embodiments, the composition and design of the flexible shaft 76 may provide a modulus of elasticity that ranges from approximately 70 GPa to approximately 250 GPa. As used herein, the term "approximately" refers to a value that is plus or minus 5% the stated value.

Figure 6B:
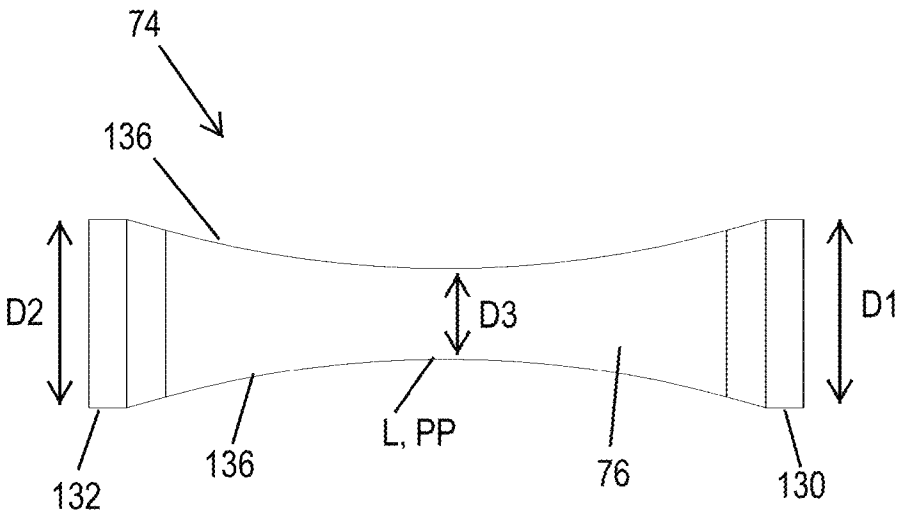
FIG. 6B is a side view of the flexible shaft of FIG. 3.

The flexibility of the flexible shaft 76 may also be determined (at least partially) by the shape/geometry of the shaft 76. As shown in FIG. 6B, the flexible shaft 76 has a first dimension D1 (e.g., first diameter) adjacent the first end 130, a second dimension D2 (e.g., second diameter) adjacent the second end 132, and a third dimension D3 (e.g., third diameter) at an intermediate location L between the first end 130 and the second end 132. In the illustrated embodiment, the location L may be equidistant from both the first end 130 and the second end 132. In other embodiments, the location L may be closer to the first end 130 than the second end 132. And in still other embodiments, the location L may be closer to the second end 132 than the first end 130. In the illustrated embodiment, the first and second dimensions D1, D2 are approximately the same (e.g., within 2% of the larger diameter). In other embodiments, the first and second dimensions D1, D2 may be different. The third dimension D3 is smaller than the first dimension D1 and the second dimension D2.

In the illustrated embodiment, the first dimension D1 is approximately 19.7 inches, the second dimension D2 is also approximately 500 mm (19.7 inches), and the third dimension D3 is approximately 260 mm (e.g., 10.2 inches). In some embodiments, the first dimension D1 may be between approximately 250 mm (e.g., 9.8 inches) and approximately 750 mm (e.g., 29.5 inches), the second dimension D2 may be between approximately 250 mm (e.g., 9.8 inches) and 750 mm (e.g., 29.5 inches), and the third dimension D3 may be between approximately 130 mm (e.g., 5.1) inches and 390 mm (e.g., 15.4 inches). In some embodiments, the ratio of the first dimension D1 to the third dimension D3 may be approximately 2:1. In some embodiments, the ratio of the first dimension D1 to the third dimension D3 may be at least approximately 2:1. In some embodiments, the ratio of the first dimension D1 to the third dimension D3 may be between approximately 1.9:1 and approximately 5.8:1. Similarly, in some embodiments, the ratio of the second dimension D2 to the third dimension D3 may be approximately 2:1. In some embodiments, the ratio of the second dimension D2 to the third dimension D3 may be at least approximately 2:1. In some embodiments, the ratio of the second dimension D2 to the third dimension D3 may be between approximately 1.9:1 and approximately 5.8:1.

In the illustrated embodiment, a dimension (e.g., a width or diameter) of the flexible shaft 76 may taper inwardly from the first end 130 toward an intermediate portion, and may taper inwardly from the second end 132 toward the intermediate portion. Stated another way, the dimension (e.g., the width or diameter) may reduce or decrease from the first end 130 to the location L and may reduce or decrease from the second end 132 to the location L. The rate of change of the dimension may be variable along the length of the shaft 76. An outer surface 136 of the flexible shaft 76 may be substantially arcuate when viewed in cross-section taken along the base axis 90, when viewed from the side, and when viewed from the top, and in some embodiments may create an hourglass shape. Accordingly, in the illustrated embodiment, the arcuate outer surface of the flexible shaft 76 may define a radius of curvature of approximately 3400 mm (e.g., 133.9 inches). In some embodiments, the arcuate outer surface of the flexible shaft may define a radius of curvature between approximately 1700 mm (e.g., 66.9 inches) and approximately 5100 mm (e.g., 200.8 inches).

Figure 7:
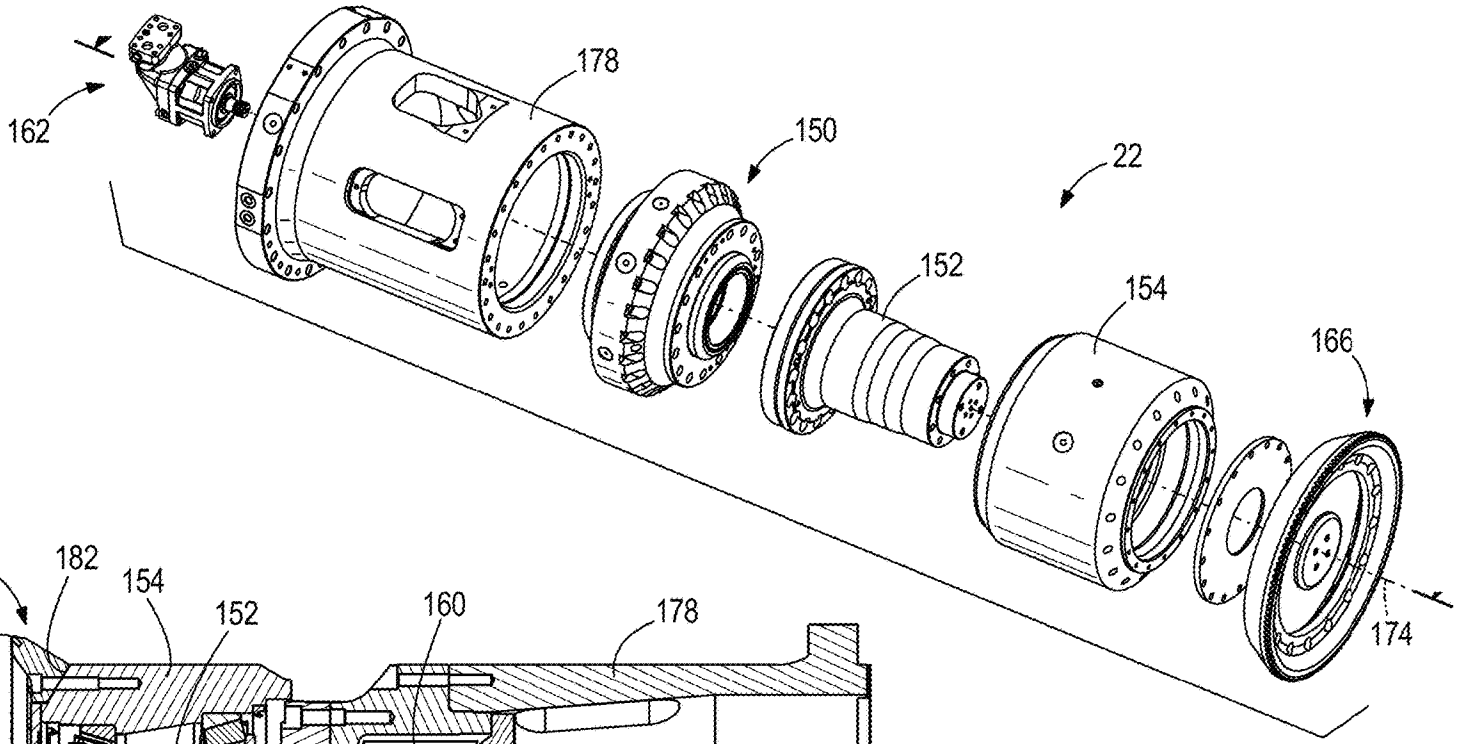
FIG. 7 is an exploded view of the cutting device of FIG. 3.
Figure 8:
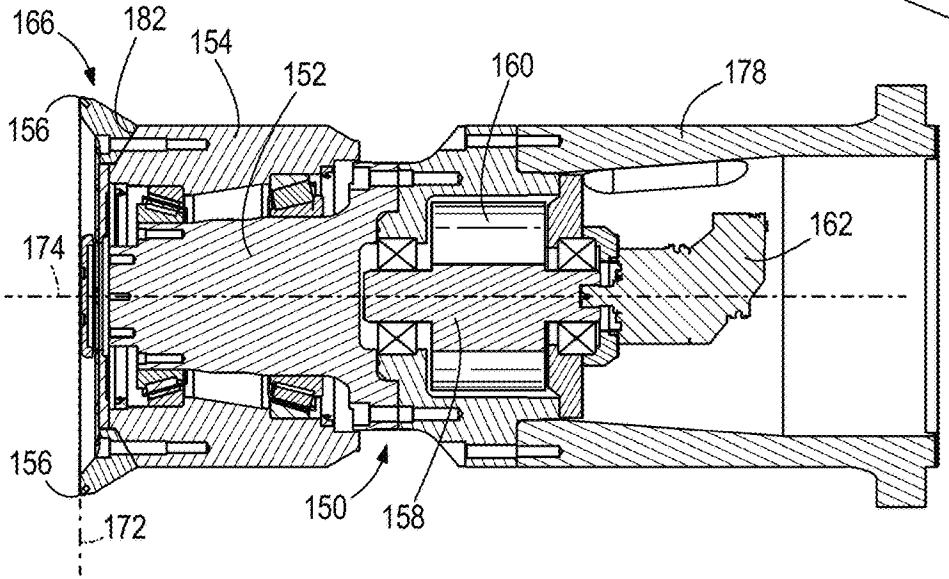
FIG. 8 is a cross-sectional view of the cutting device of FIG. 3, along the line 8-8 of FIG. 1.

Referring to FIGS. 5A and 7, the cutting device 22 includes a cutting bit or cutting disc 166 having a peripheral edge 170, and a plurality of cutting bits 156 (FIG. 8) positioned along the peripheral edge 170. The peripheral edge 170 may be oriented in a cutting plane 172 (FIG. 5A), and the cutting disc 166 is rotatable about a cutter axis 174 (FIG. 5A). The cutter axis 174 is generally perpendicular to the cutting plane 172. The cutter axis 172 is positioned at a non-parallel angle relative to the wrist axis 134. Moreover, the cutter axis 174 is fixed relative to the wrist axis 134. The angle between the cutter axis 174 and the wrist axis 134 may be approximately 7 degrees. In some embodiments, the angle between the cutter axis 174 and the wrist axis 134 may be between approximately 3 degrees and approximately 10 degrees. Accordingly, the cutting plane 172 is at a fixed, non-perpendicular angle relative to the wrist axis 134. The angle between the cutting plane 172 and the wrist axis 134 may be approximately 83 degrees. In some embodiments, the angle between the cutting plane 172 and the wrist axis 134 may be between approximately 80 degrees and approximately 87 degrees. The cutting plane 172 is adjustable relative to the base axis 90. That is, because the cutter 22 is coupled to the flexible shaft 76, the cutter 22 is movable in a rotational and translational manner with the flexible shaft 76. Rotation of the flexible shaft 76 (via the slew drive), may therefore change the orientation of the cutter plane 172 relative to the base axis 90.

In the illustrated embodiment, the cutting device 22 further includes a housing 178, an excitation element 150, and a shaft 152 removably coupled (e.g., by fasteners) to the excitation element 150. The housing 178 is coupled (via fasteners) to the flexible shaft 76. The cutting disc 166 is coupled (e.g., via fasteners) to a carrier 154 that is supported on an end of the shaft 152 for rotation (e.g., by roller bearings) about the cutter axis 174. In the illustrated embodiment, the cutting disc 166 engages the carrier 154 along an inclined surface 182 forming an acute angle relative to the cutting plane 172. Stated another way, the cutting disc 166 abuts a surface 182 tapering inwardly toward the cutter axis 174 in a direction oriented away from the housing 178. In some embodiments, the cutting disc 166 is supported for free rotation relative to the housing 178 (i.e., the cutting disc 166 is neither prevented from rotating nor positively driven to rotate except by induced oscillation).

In the illustrated embodiment, the end of the shaft 152 is formed as a stub or cantilevered shaft generally extending parallel to the cutter axis 174. The excitation element 150 may include an exciter shaft 158 and an eccentric mass 160 secured to the exciter shaft 158 for rotation with the exciter shaft 158. The exciter shaft 158 is driven by a motor 162 and is supported for rotation (e.g., by roller bearings). The rotation of the eccentric mass 160 induces an eccentric oscillation in the shaft 152, thereby inducing oscillation of the cutting disc 166. In some embodiments, the structure of the cutting device 22 and excitation element 150 may be similar to the cutter head and excitation element described in U.S. Patent Publication No. 2017/0211383, published Jul. 27, 2017 the entire contents of which are hereby incorporated by reference. In other embodiments, the cutting device 22 and excitation element 150 may be similar to the exciter member and cutting bit described in U.S. Publication No. 2014/0077578, published Mar. 20, 2014, the entire contents of which are hereby incorporated by reference.

Although not shown herein, it should be understood that in the illustrated embodiment the cutter axis 174 is configured to be oriented at an angle relative to a tangent of the rock face 30 at a contact point with the cutting disc 166. In some embodiments, the angle is between approximately 0 degrees and approximately 25 degrees. In some embodiments, the angle 186 is between approximately 1 degree and approximately 10 degrees. In some embodiments, the angle 186 is between approximately 3 degrees and approximately 7 degrees. In some embodiments, the angle 186 is approximately 5 degrees.

The cutting device 22 engages the rock face 30 by undercutting the rock face 30. That is, a leading edge of the cutting disc 166 engages the rock face 30 such that the cutting disc 166 (e.g., the cutting plane 172) forms a low or small angle relative to the rock face 30 and traverses across a length of the rock face 30 in a cutting direction 190. As shown in FIG. 5A, orienting the cutting disc 166 at an angle allows the leading edge 166*a* of the cutting disc 166 to engage the rock face 30 and provides clearance between the rock face 30 and a trailing edge 166*b* of the cutting disc 166 (i.e., a portion of the edge that is positioned behind the leading edge 166*a* with respect to the cutting direction 190). The angle of the cutting disc 166 can be adjusted, for example, by rotating the second structure 100 and therefore the flexible shaft 76 via the slew drive, while the distance of the cutting disc 166 relative to the base portion 70 can be adjusted, for example, by translating the second structure and therefore the flexible drive shaft via the fluid actuator 116.

Figure 9:
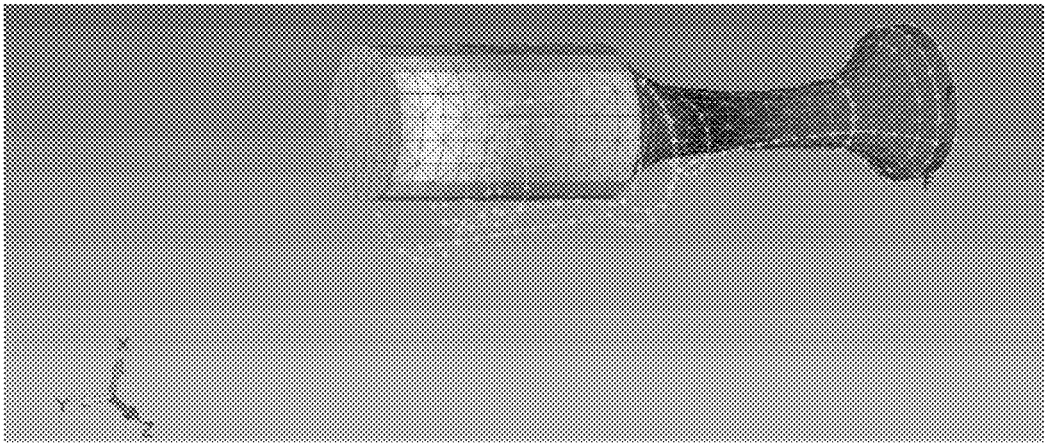
FIG. 9 is a perspective view of the flexible shaft of the boom of FIG. 3 in a deflected position.

The eccentric oscillation of the shaft 152 correspondingly induces movement (e.g., pivoting movement of the flexible shaft 76). That is, rotation of the mass 160 also causes the flexible shaft 76 to move or pivot relative to the second structure 100. In particular, the flexible shaft 76 is pivotable relative to the first end 106 of the second structure 100 where the flexible shaft 76 is coupled and is pivotable about a pivot point PP that is positioned between the first end 130 and the second end 132. In the illustrated embodiment, the pivot point PP may be positioned adjacent the location L of the third dimension D3 (e.g., the narrowest section of the shaft 76). In other embodiments, the pivot point PP may be between the location L and the second end or between the location L and the first 130 end 132. The location of the pivot point PP may depend on the location of the narrowest dimension of the shaft, the mechanical couplings/constraints on the shaft 76, and/or other factors. An exemplary illustration of the flexible shaft in a deflected condition is shown in FIG. 9. The flexible shaft 76 enables the wrist portion 74 and cutting device 22 to oscillate and/or pivot relative to the base portion 70 about a virtual pivot point. Moreover, in some embodiments, the flexible shaft 76 may assist in limiting or isolating the vibrations that are transmitted to the rest of the machine 10.

Figure 10A:
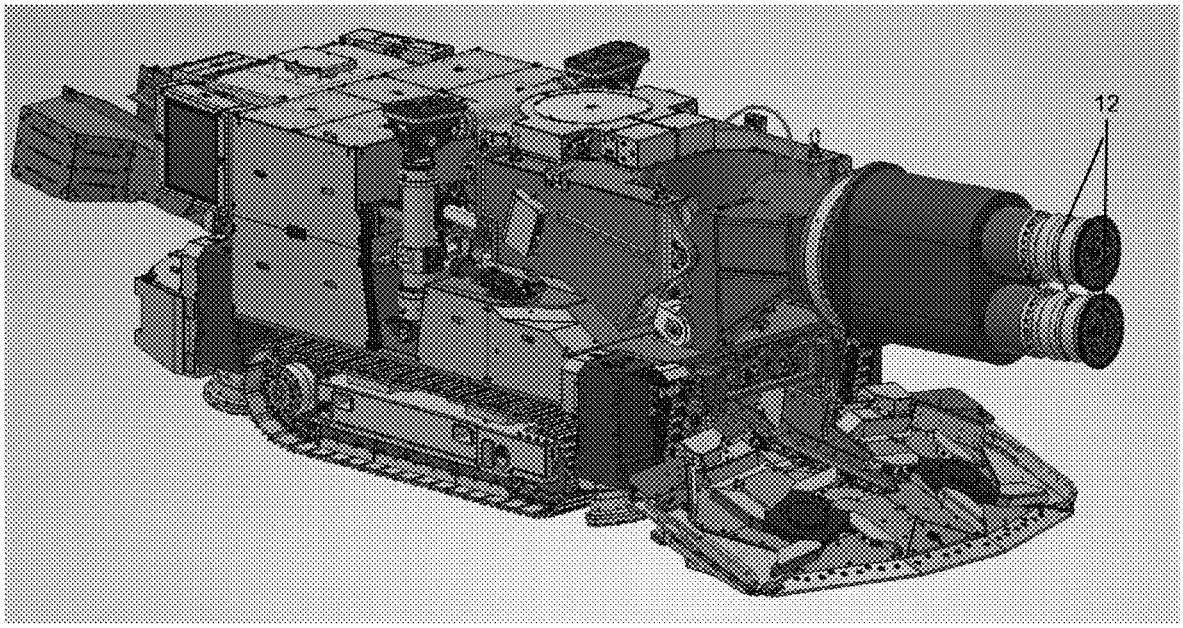
FIG. 10A illustrates an excavation machine including a first boom and a second boom, each of the first boom and second the boom having the features of FIG. 3.

The flexible shaft 76 and boom 18' are shown and described relative to a single-boom excavation machine in FIGS. 1-9. The flexible shaft 76 and the boom 18' may be used in other types of machines. For example, the flexible shaft 76 may be used in a double-boom excavation machine (FIG. 10A). In some embodiments, the double-boom excavation machine may include a first flexible shaft and a second flexible shaft, and each flexible shaft supports a cutter device 22. Each of the first and second flexible shafts may be rotatable and translatable to adjust the position of the respective cutting device 22 relative to the rock face, as discussed above. The first and second flexible shafts may be at least partially supported by a common housing or yoke and may extend and retract together. Each of the first and second flexible shafts may include the same or similar components as the boom 18'. In other embodiments, the flexible shaft 76 may be used in conjunction with a construction machine, a shaft sinking machine, a road planning machine, and a tunnel boring machine or other type of entry development machine, among others.

Although various aspects have been described in detail with reference to certain embodiments, variations and modifications exist within the scope and spirit of one or more independent aspects as described.

What is claimed is:

1. A cutting assembly for a rock excavation machine having a frame, the cutting assembly comprising:

a base portion configured to be supported by the frame, the base portion defining a base axis;

a flexible shaft including a first end and a second end opposite the first end, the first end coupled to the base portion, the second end being movable relative to the first end and deflectable away from the base axis; and a cutting device supported on the second end of the flexible shaft.

2. The cutting assembly of claim 1, wherein the base portion includes a first structure and a second structure that is supported for movement relative to the first structure along the base axis, the second structure including a first end and a second end opposite the first end.

3. The cutting assembly of claim 2, wherein the flexible shaft is movable with the second structure along the base axis, and the second end of the flexible shaft is movable relative to the second structure about a pivot point, the pivot point positioned between the first end and the second end of the flexible shaft.

4. The cutting assembly of claim 2, wherein the base portion includes an elongated slot, and further comprising a linkage coupled to the second structure and including an end positioned within the slot and movable within the slot, engagement between the linkage and the slot resisting torque exerted on the second structure.

5. The cutting assembly of claim 2, further comprising a gear drive for rotating the flexible shaft relative to the second structure about the base axis, the gear drive supported on a bracket positioned adjacent the first end of the second structure.

6. The cutting assembly of claim 1, wherein the cutting device includes a cutting disc having a cutting edge positioned in a cutting plane, and the cutting plane is oriented at a non-perpendicular angle relative to an axis of the flexible shaft proximate the second end of the flexible shaft.

7. The cutting assembly of claim 1, wherein the cutting device includes a cutting disc and an excitation device, the excitation device including an eccentric mass supported for rotation in an eccentric manner and positioned proximate the cutting disc, rotation of the eccentric mass inducing oscillation of the cutting device, and oscillation of the cutting device inducing oscillation of the flexible shaft.

8. The cutting assembly of claim 1, wherein the flexible shaft is constructed from one or more of steel, aluminum, and/or a titanium alloy.

9. The cutting assembly of claim 1, wherein the first end of the flexible shaft has a first width, the second end of the flexible shaft has a second width, and the flexible shaft has a third width at a location between the first end and the second end, the third width being smaller than the first width and the second width.

10. The cutting assembly of claim 9, wherein a ratio of the first width to the third width is approximately 2 to 1.

11. A cutting assembly for a rock excavation machine, the cutting assembly comprising:

a base portion;

a cutting device including a cutting edge; and a flexible shaft supporting the cutting device relative to the base portion, the flexible shaft including a first end, a second end opposite the first end, and a shaft axis extending therebetween, the first end coupled to the base portion, the second end coupled to the cutting device, a width of the flexible shaft tapering inwardly in a direction between the first end and an intermediate position located between the first end and the second end, the width of the flexible shaft tapering inwardly in a direction between the second end and the intermediate position, the width of the flexible shaft proximate the intermediate position being less than the width proximate the first end and less than the width proximate the second end.

12. The cutting assembly of claim 11, wherein the base portion includes a first structure and a second structure that is supported for movement relative to the first structure along a base axis, the second structure including a first end and a second end opposite the first end, the flexible shaft coupled to the second structure, the cutting device positioned adjacent the first end of the second structure.

13. The cutting assembly of claim 12, wherein the flexible shaft is movable with the second structure along the base axis, and the second end of the flexible shaft is movable relative to the second structure about a pivot point, the pivot point positioned between the first end and the second end of the flexible shaft.

14. The cutting assembly of claim 12, wherein the base portion includes an elongated slot, and further comprising a linkage coupled to the second structure and including an end positioned within the slot and movable within the slot, engagement between the linkage and the slot resisting torque exerted on the second structure.

15. The cutting assembly of claim 12, further comprising a gear drive for rotating the flexible shaft relative to the second structure about the base axis, the gear drive supported on a bracket positioned adjacent a first end of the second structure.

16. The cutting assembly of claim 11, wherein the cutting device includes a cutting disc having a cutting edge positioned in a cutting plane, and the cutting plane is oriented at a non-perpendicular angle relative to an axis of the flexible shaft proximate the second end of the flexible shaft, the cutting device further including a cutting disc and an excitation device, the excitation device including an eccentric mass supported for rotation in an eccentric manner and positioned proximate the cutting disc, rotation of the eccentric mass inducing oscillation of the cutting device, and oscillation of the cutting device inducing oscillation of the flexible shaft.

17. The cutting assembly of claim 11, wherein a ratio of the width of the flexible shaft proximate the first end to the width of the flexible shaft proximate the intermediate position is approximately 2 to 1.

18. A cutting assembly for a rock excavation machine, the cutting assembly comprising:

a base portion including a first structure and a second structure supported for movement relative to the first structure along a base axis;

a cutting device including a cutting edge, the cutting device positioned adjacent a distal end of the second structure; and a flexible shaft including a first end, a second end opposite the first end, and a shaft axis extending therebetween, the flexible shaft further including an intermediate position located between the first end and the second end, deflection of the flexible shaft moving the second end away from the base axis, the first end coupled to a proximal end of the second structure, the second end coupled to the cutting device, a width of the flexible shaft reducing inwardly in a direction between the first end and the intermediate position, the width of the flexible shaft reducing inwardly in a direction between the second end and the intermediate position, the width of the flexible shaft proximate the intermediate position being less than the width proximate the first end and less than the width proximate the second end.

19. The cutting assembly of claim 18, wherein the base portion includes an elongated slot, and further comprising a linkage coupled to the second structure, the linkage including an end positioned within the slot and movable within the slot, engagement between the linkage and the slot maintaining the second structure in a desired orientation relative to the first structure.

20. The cutting assembly of claim 18, further comprising a gear drive for rotating the flexible shaft relative to the second structure about the base axis, the gear drive supported on a bracket positioned adjacent the proximal end of the second structure.

* * * * *